US006941580B2

(12) United States Patent
Kolcio et al.

(10) Patent No.: US 6,941,580 B2
(45) Date of Patent: Sep. 13, 2005

(54) METHOD FOR ACCESSING ELECTRICAL COMPONENTS WITH GLOVED HANDS

(76) Inventors: Nestor Kolcio, 11500 Jerome Rd., Plain City, OH (US) 43064; Bohdan R. Kolcio, 314 W. 83rd St., Apt. 1, New York, NY (US) 10024

( * ) Notice: Subject to any disclaimer, the term of this patent is extended or adjusted under 35 U.S.C. 154(b) by 453 days.

(21) Appl. No.: 09/954,788

(22) Filed: Sep. 18, 2001

(65) Prior Publication Data

US 2002/0035744 A1 Mar. 28, 2002

Related U.S. Application Data

(60) Provisional application No. 60/234,876, filed on Sep. 22, 2000.

(51) Int. Cl.[7] ..... A41D 19/00
(52) U.S. Cl. ..... 2/161.6; 2/168
(58) Field of Search ..... 2/16, 161.6, 161.7, 2/161.8, 163, 167, 168, 169

(56) References Cited

U.S. PATENT DOCUMENTS 1,940,491 A * 12/1933 Freitag ..... 2/161
3,596,134 A * 7/1971 Burke ..... 2/161
3,761,965 A * 10/1973 Barasch ..... 2/167
3,883,899 A * 5/1975 Ganz ..... 2/168
4,536,890 A * 8/1985 Barnett et al. ..... 2/164
4,583,039 A * 4/1986 Kolcio et al. ..... 324/54
4,921,672 A * 5/1990 Bock ..... 264/161

FOREIGN PATENT DOCUMENTS

FR 2448307 * 9/1980 ..... A41D/13/10

* cited by examiner

*Primary Examiner*—Katherine M Moran
(74) *Attorney, Agent, or Firm*—Mueller and Smith, LPA

(57) ABSTRACT

A method for accessing electrical equipment with ASTM Class 00 and Class 0, gloves by a procedure wherein the gloves are periodically removed and put back on to accommodate sweat and heat development. Removal of the tight fitting gloves as well as putting them on is facilitated by the incorporation of a flock lining at those internal surfaces of the gloves which are exposed to important sweat generation. In order to enhance tool manipulation and maneuvering small components such as washers, bolts, nuts and the like, the glove exterior regions of finger tips, fingers and palm (the regions described as the work area of the glove) are made to have a rough surface.

14 Claims, 3 Drawing Sheets

METHOD FOR ACCESSING ELECTRICAL COMPONENTS WITH GLOVED HANDS

CROSS-REFERENCE TO RELATED APPLICATIONS

This application claims the benefit of U.S. Provisional Application No. 60/234,876 filed Sep. 22, 2000.

STATEMENT REGARDING FEDERALLY SPONSORED RESEARCH

Not applicable.

BACKGROUND OF THE INVENTION

Essentially all modem industries utilize facilities which include a wide variety of applications of electrical systems. Those electrical systems will be accessed from time to time by electrical system technicians carrying out system alterations or maintenance. Because the systems accessed by the technicians very often will be electrically active or "live", both industry associations and governmental regulatory organizations have imposed safety criteria. For instance, standards have been established for insulating gloves which cover a variety of uses with electrical equipment ranging from line activities to the accessing of electrical equipment housed in cabinets or enclosures. With respect to the latter applications, for relatively lower encountered equipment voltages, the technicians are required to carry out certain protective procedures. For example, equipment which is energized may be covered with protective insulating sheeting and work is carried out on or near energized components. This approach in many instances is highly inconvenient and time consuming. Alternately, for specified lower voltage ranges, a rubber-type insulating glove may be utilized with or without outer leather protector gloves. The protector gloves may be omitted from insulating gloves where small equipment and parts manipulation require unusually good finger dexterity. In this regard, for electrical equipment energized between 1000 volts rms down to 50 volts rms, specific insulating gloves identified as ASTM Class 0 may be used. Between 500 volts rms down to 50 volts rms, specific insulating gloves identified as ASTM Class 00, may be used by the technician. Between 250 and 500 volts rms, the Class 00 gloves are required by regulation to be used in conjunction with outer leather protective gloves. However, these protectors function to maintain the integrity of the underlying insulating gloves but provide such protection in conjunction with both discomfort and a substantial limitation to the hand dexterity of the user. On the other hand, Class 0 gloves for special applications may be used without the protector gloves between 50 and 1000 volts rms. Where Class 00 and Class 0 gloves have been used without external protectors as with the noted lower voltage ranges, studies carried out with the gloves have indicated that they need to be tight fitting over the hand in order to permit sufficient finger dexterity to maneuver small electrical system components such as washers, bolts, nuts and the like. Technicians have been observed to be able to wear these tight fitting insulative gloves for accessing equipment at low voltage ranges only for about two minutes before heat builds and sweat forms within the gloves to the extent of discomfort and difficulty in removing the gloves. Because of the sweat-based moisture buildup, the removal procedure requires that the gloves be reversed or turned inside-out. This, in turn, poses difficulties in putting the gloves back on in order to continue accessing the electrical system to the extent that technicians will seek other, gloveless techniques for working on electrical equipment. The ideal solution to the problem as is sought by the industry is to accept the fact that the gloves will become hot, but to construct them such that they are easy to put on and take off for purposes of drying and cooling the hands of the technicians and then for protecting the technician against electrical shock.

BRIEF SUMMARY OF THE INVENTION

The present invention is addressed to a method whereby electrical technicians may access electrical equipment for contact with tight fitting ASTM Class 00 and Class 0 Rubber Insulating Gloves. These tight fitting gloves are lined with a flock provided at the interior of the glove to an extent wherein removal of the glove from the hand and positioning on the hands is carried out without substantial effort. Thus the lower voltage electrical components may be accessed with a practical procedure which includes the steps of periodically removing the gloves and then putting them back on.

One aspect of the method provides the flock lined gloves by spraying non-conducting adhesive born flock through the cuff opening of an unreversed Class 00 and/or Class 0 glove, it having been determined that by so lining the glove, those interior surfaces of it which are prone to exposure to sweat moisture are covered with liner or flock while those exuding minimal sweat development remain unlined. This approach permits an enhancement of the sense of touch through the glove. That sense of touch further is enhanced by roughening the interior surfaces of the finger portions of the glove as well as the palm area where such regions are defined as the work area of the gloves.

Other objects of the invention will, in part, be obvious and will, in part, appear hereinafter.

The invention, accordingly, comprises the method possessing the steps which are exemplified in the following detailed description.

For a fuller understanding of the nature and objects of the invention, reference should be made to the following detailed description taken in connection with the accompanying drawings.

DETAILED DESCRIPTION OF THE INVENTION

Figure 1:
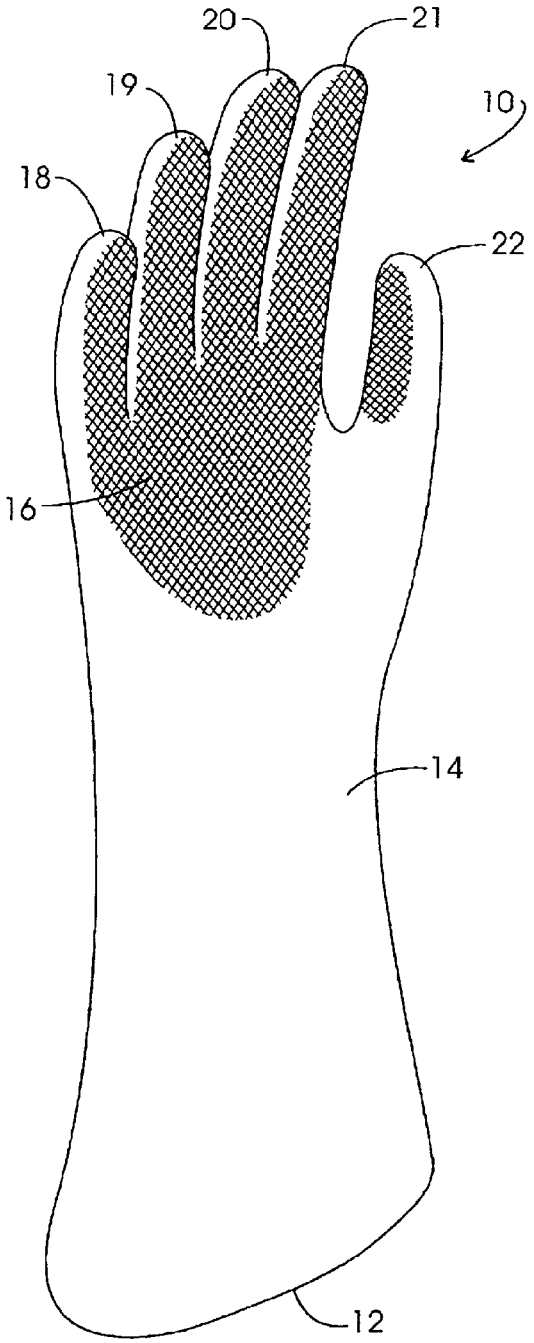
FIG. 1 is a front view of an electrically insulating glove employed with the method of the invention.

The methodology of the present invention is one wherein the technician is supplied a pair of ASTM Class 00 or Class 0 tight fitting gloves, the interiors of which are lined with a liner formed as an adhesively applied flock. That flock functions to permit the technician to remove the gloves quite easily and provides an amount of "wicking" functioning to prolong the interval of wear. A further feature of the gloves permitting requisite finger dexterity when working with cabinet enclosed equipment and the like is to provide a roughening or ridging at the external palm and finger sheathing portions of the gloves to facilitate the maneuvering of small components with fingers. Because this form of glove currently is manufactured by dipping a glove mold in liquid polymeric solution a number of times sufficient to reach mandated thickness, it has been found to be highly expensive to incorporate flock forms of liners. This expense is occasioned by the manufacturing process wherein following formation by multiple dipping, the gloves must be turned inside-out prior to the application of the flock liner.

However, it may be observed that sweat is evoked from sudorific glands. These glands are divisible into two types: eccrine glands, numerous and present over almost all of the body surface and apocrine glands, confined to a few restricted areas. Eccrine sweat glands are long un-branched tubular structures, each with a highly coiled, wider secretory portion situated deep in the dermis or hypodermis and a narrower, straight or slightly helical ductular portion, which in the deeper layers of the dermis is convoluted or twisted. The walls of the duct fuse with the base of epidermal (reten) papillae and the lumen passes between the keratinocytes often, particularly in thick hairless skin in a tight spiral to open via a rounded epicure onto the cutaneous surface.

Sweat glands secrete a clear, odourless fluid, hypotonic to tissue fluid and containing small quantities of many substances, predominately sodium and chloride items but also urea, lactate, amino acids, immunoglobulins and other proteins, bicarbonate, calcium items and the like. When initially secreted, the fluid is similar in composition to tissue fluid but is modified as it passes along the duct by the action of its lining cells, which resorb sodium and chloride and some water also. Of importance to the instant invention, however, while secretion is stimulated chiefly by temperature rise, for the case of the hands of the body, the glands react most strongly to emotional stimuli. Of further importance, the numbers of sweat glands are greater on the flexor aspects of the hands, while the surfaces of the limbs generally have the fewest. Accordingly, an effective lining may be applied with gloves for use by electrical technicians which carry the lining from the open end of the gloves toward the palm and top of the hand, leaving the fingertips somewhat free of liner. This achieves the objective of making the gloves easy to take off and put on and also enhances the touch and feel aspect of the fingertips without detriment to the overriding need to provide gloves which are easy to put on and take off. Because of the particular features of the sweat glands at the hands, the gloves may be flocked without turning them inside-out permitting their unique application to accessing electrical equipment.

Looking to FIG. 1, an ASTM Class 00 or Class 0 glove is shown in general at 10. Glove 10 includes a cuff or opening 12 from which its sleeve or gauntlet portion 14 extends to the palm and top of the hand portion 16, in turn leading to the finger and thumb sheaths 18–22. Note that the inside of each of the finger and thumb portions 18–22 is roughened by formation of triangular ridges as is the palm region at 16. This has been found important for improving the dexterity of the technician in maneuvering small electrical components.

Figure 2:
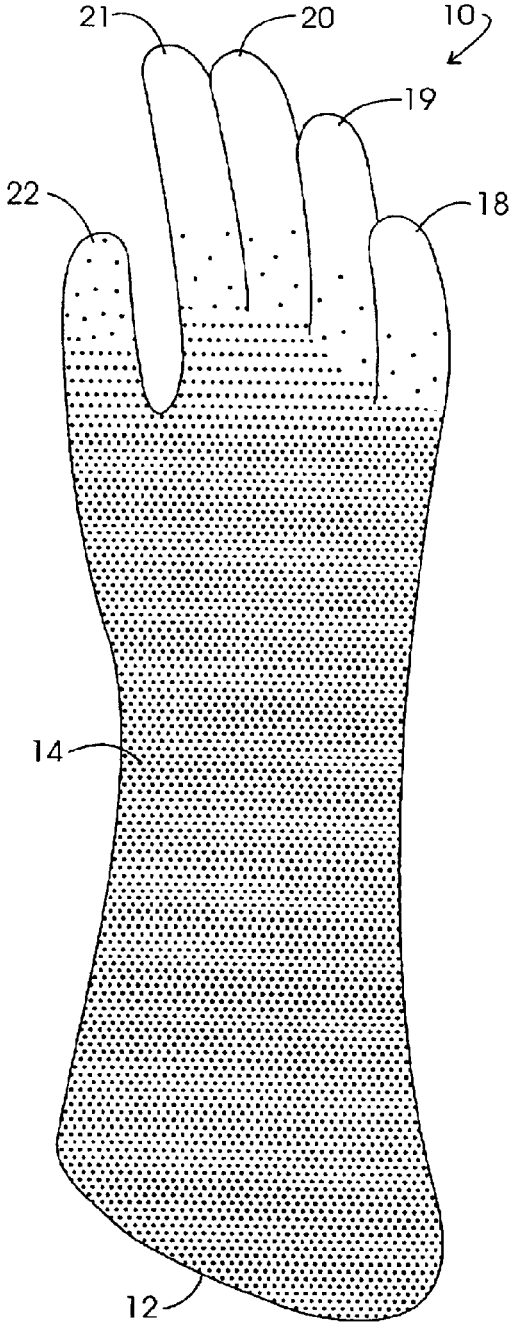
FIG. 2 is a front view of the glove of FIG. 1 showing it turned inside-out.

Looking to FIG. 2, the gloved hand again is illustrated with the same identifying numeration but as it is turned inside-out to reveal the formation of flocking or liner. Note that the liner, as represented in dotted fashion is full or dense through the palm and forehand region but diminishes at the base of the finger sheaths 18–22, being absent, for example, at the tips of finger portions 18–21 and substantially absent at the tips of the sheath covering the thumb at 22.

Figure 3:
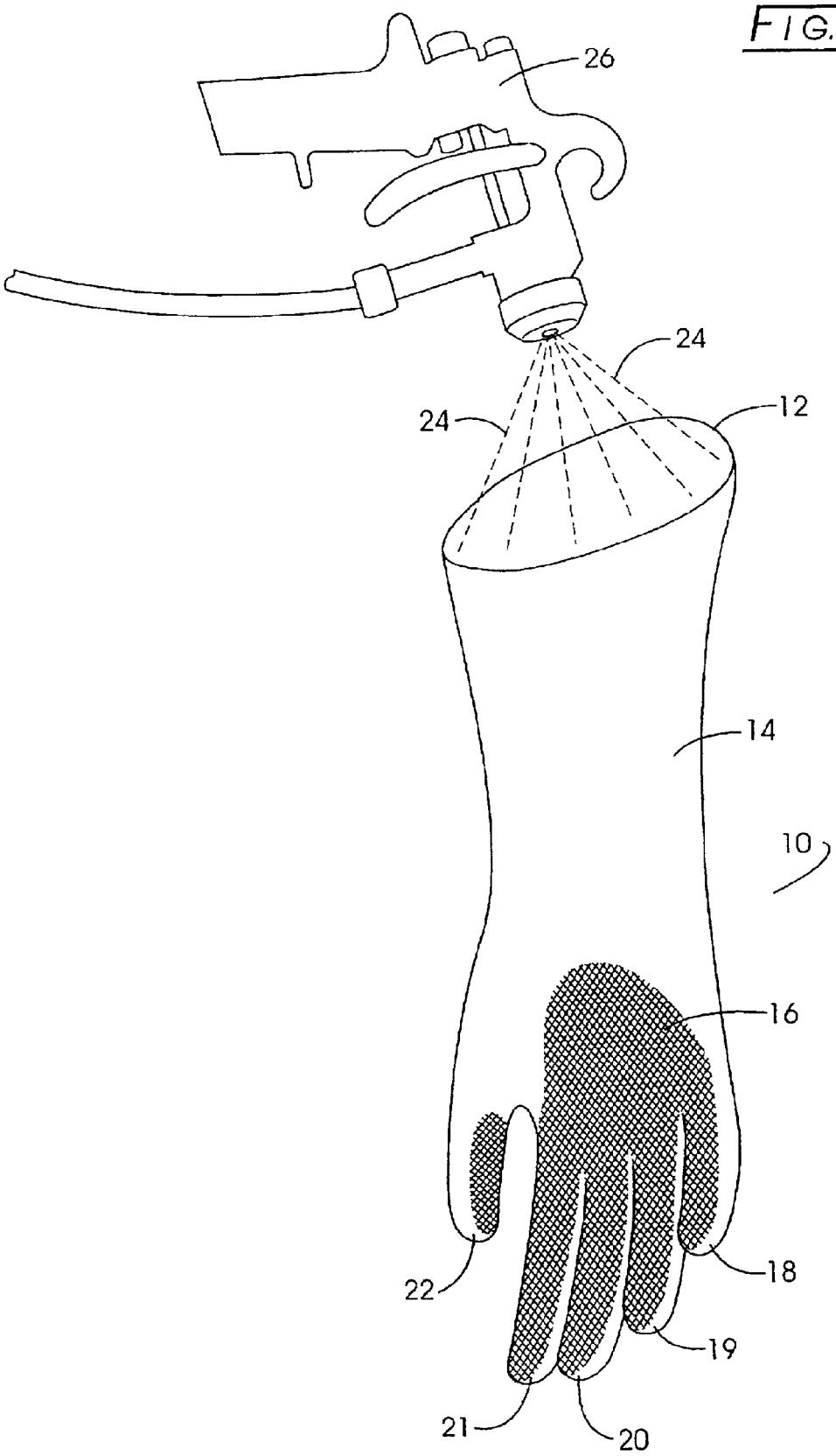
FIG. 3 is a perspective view showing a technique for flocking the glove of FIG. 1.
Figure 4:
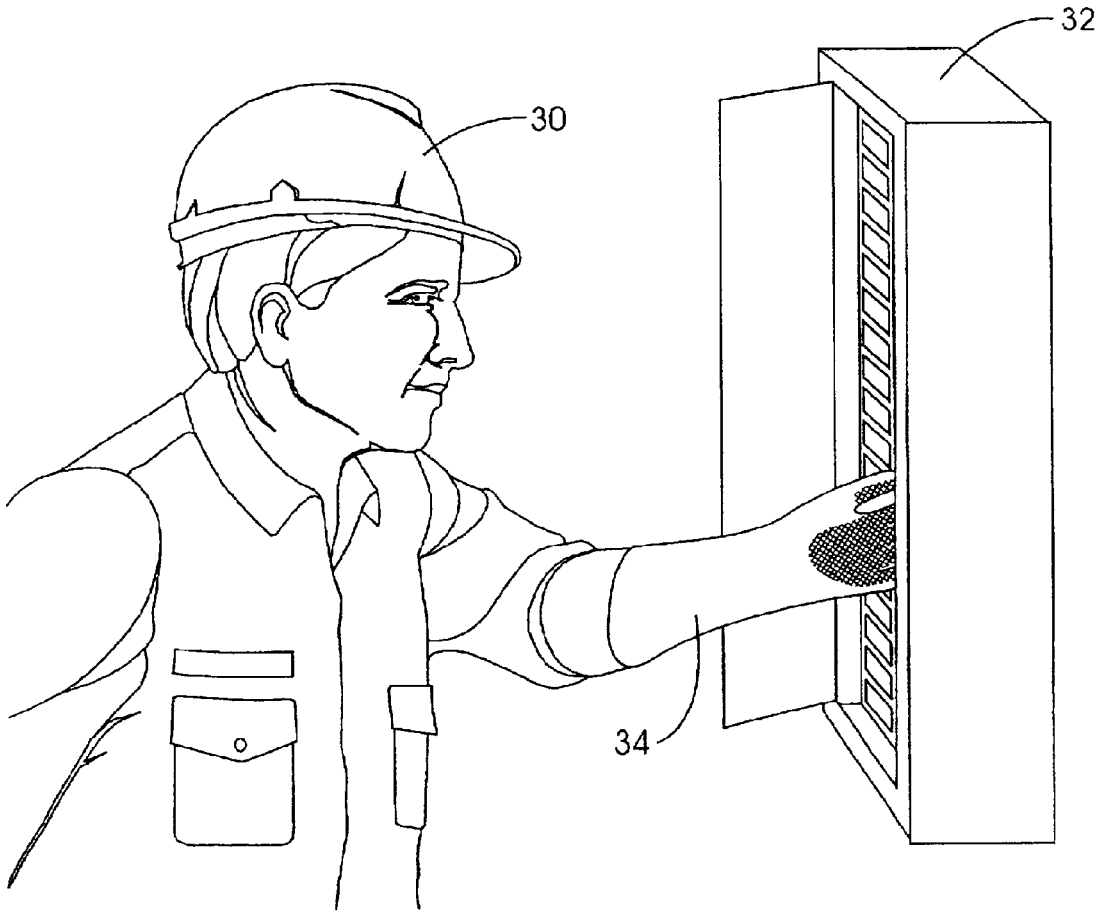
FIG. 4 is a perspective view of an electrical technician carrying out the method of the invention.

Referring to FIG. 3, the simplified technique by which glove 10 is fashioned with a flock liner is illustrated. In the figure, the open cuff 12 of the glove 10 is exposed and a combination of flock and non-conducting adhesive is sprayed as represented at dashed line 24 from spray gun 26. Upon curing or drying of the adhesive, glove 10 remains sufficiently flexible for the electrical technicians' use, the flock promoting the wicking out of moisture from the interior of the glove and substantially facilitating its being removed and replaced upon the technicians hand to permit an accessing of electrical equipment. The latter procedure is shown as a technician 30 accessing equipment 32 in FIG. 4. Note that the technicians' arm is protected by a Class 00 or Class 0 protective glove 34. Accordingly, with the arrangement as shown in FIG. 4, a method is provided wherein an insulating glove of Class 00 and Class 0 meeting the ASTM Standard Specification for Rubber Insulating Gloves and are used in accordance with ASTM Standard Specification for In-Service Care of Insulating Gloves and Sleeves is provided to the technician 30. The tightly fitting glove worn by the technician is lined at least at the palm region, hand back and initial finger joint regions of its interior with a non-conductive adhesively retained flock. The glove then, as lined, is placed on the hand to provide a gloved hand for the technician who then may access electrical components with the gloved hand and, importantly, periodically may remove the glove from the gloved hand to permit moisture and heat to be removed from the interior of the glove. Further, the glove then may be put back on with little effort by technician 30. Preferably, the internal fingertip regions are roughened as disclosed to facilitate the manipulation of small electrical components.

Since certain changes may be made in the above-described method without departing from the scope of the invention herein involved, it is intended that all matter contained in the description thereof or shown in the accompanying drawings shall be interpreted as illustrative and not in a limiting sense.

What is claimed is:

1. The method for accessing electrical components energized at voltage of about 500 volts rms and below, comprising the steps of:

(a) providing at least one tightly fittable rubber insulating glove effective to electrically insulate a gloved hand from said electrical components, said glove having a palm region, a hand back region, and finger sheaths, each of said finger sheaths extending from a base region to a fingertip region;

(b) lining at least the palm region and hand back region of the interior of the glove with a non-conductive, adhesively retained flock effective to facilitate removal of the glove from the hand with the flock diminishing from the bases of the finger sheaths to be substantially absent at the fingertip regions;

(c) placing said lined glove on the hand to provide a tightly fitting gloved hand;

(d) accessing said electrical components with said gloved hand; and (e) periodically removing said glove from said gloved hand to cool and remove moisture from the hand and glove and thereafter replacing said glove upon said hand.

2. The method of claim 1 including the step of:

(f) subsequent to said step (a) roughening the external surface of said glove at said inward fingertip regions to an extent effective to facilitate the finger manipulation of small parts of said electrical components while maintaining said effective electrical insulation.

3. The method of claim 2 in which said glove is roughened at said inward fingertip regions and at the palm region thereof.

4. The method of claim 3 in which said glove is roughened at said inward fingertip regions and at said palm region by the formation of ridges extending into its external surface.

5. The method of claim 4 in which said formation of ridges is provided as a triangular pattern.

6. The method of claim 1 in which said step (b) is carried out by lining at least said palm region, hand back region and the initial finger joint regions of the glove.

7. The method of claim 1 in which said step (b) is carried out by spraying a non-conductive adhesive born flock through the hand access opening of said glove.

8. The method for accessing electrical components energized at voltages of less than about 1000 volts rms, comprising the steps of:

(a) providing at least one tightly fittable rubber insulating glove effective to electrically insulate a gloved hand from said electrical components, said glove having a palm region, a hand back region, and finger sheaths, each of said finger sheaths extending from a base region to a fingertip region;

(b) lining at least the palm region and hand back region of the interior of the glove with a non-conductive adhesively retained flock effective to facilitate removal of the glove from the hand with the flock diminishing from the bases of the finger sheaths to be substantially absent at the fingertip regions;

(c) placing said lined glove on the hand to provide a tightly fitting gloved hand;

(d) accessing said electrical components with said tightly gloved hand; and (e) periodically removing said glove from said gloved hand to cool and remove moisture from the hand and glove and thereafter replacing said glove upon said hand.

9. The method of claim 8 including the step of:

(f) subsequent to said step (a) roughening the external surface of said glove at the inward fingertip regions to an extent effective to facilitate the finger manipulation of small parts of said electrical components while maintaining said effective electrical insulator.

10. The method of claim 9 in which said glove is roughened at said inward fingertip regions and at the palm region thereof.

11. The method of claim 10 in which said glove is roughened at said inward fingertip regions and at said palm region by the formation of ridges extending into its external surface.

12. The method of claim 11 in which said formation of ridges is provided as a triangular pattern.

13. The method of claim 8 in which said step (b) is carried out by lining at least said palm region, hand back region and the initial finger joint regions of the glove.

14. The method of claim 8 in which said step (b) is carried out by spraying a non-conductive adhesive born flock through the hand access opening of said glove.

* * * * *